US006588921B2

(12) United States Patent
Koons et al.

(10) Patent No.: US 6,588,921 B2
(45) Date of Patent: Jul. 8, 2003

(54) REFLECTOR

(75) Inventors: Kevin D. Koons, Seymour, IN (US); Paul W. Krinop, Osgood, IN (US)

(73) Assignee: Valeo Sylvania LLC., Seymour, IN (US)

( * ) Notice: Subject to any disclaimer, the term of this patent is extended or adjusted under 35 U.S.C. 154(b) by 0 days.

(21) Appl. No.: 09/954,851

(22) Filed: Sep. 18, 2001

(65) Prior Publication Data

US 2003/0053313 A1 Mar. 20, 2003

(51) Int. Cl.[7] ..... F21V 29/00
(52) U.S. Cl. ..... 362/294; 362/373; 362/547
(58) Field of Search ..... 362/294, 373, 362/547, 362, 96

(56) References Cited

U.S. PATENT DOCUMENTS 4,405,974 A * 9/1983 Quiogue ..... 362/294
6,065,856 A * 5/2000 Hiramatsu et al. ..... 362/547

* cited by examiner

*Primary Examiner*—Sandra O'Shea
*Assistant Examiner*—Guiyoung Lee
(74) *Attorney, Agent, or Firm*—William E. Meyer

(57) ABSTRACT

A reflector for a lamp is provided, the reflector including a vent hole extending through the reflector body. A first enclosure extends into the reflector body from an outer reflective surface, and a second enclosure extends into the reflector body from an opposite inner surface. The second enclosure overlaps and intersects the first enclosure in such a way as to form a continuous vent hole extending from the outer surface to the inner surface, the vent hole being obscured when looking at the first surface.

5 Claims, 4 Drawing Sheets

REFLECTOR

TECHNICAL FIELD

The present invention relates to a reflector for use with a lamp, the reflector having a vent hole for venting fluid through the reflector from the front of the reflector to the rear of the reflector,the vent hole being obscured when viewing the front surface of the reflector. The reflector is particularly useful with lamp assemblies in automotive applications.

BACKGROUND ART

There are many uses for reflectors with lamp assemblies. For example, the use of reflectors is known in the automobile industry, reflectors being commonly used, for example, with headlamps. Headlamps are typically enclosed assemblies which generally include a lamp extending into a housing which is enclosed by a lens, an inner surface of the housing forming the reflector. During the life of the headlamp, there is a tendency for air and moisture to accumulate in the housing. The moisture tends to cloud the lens and otherwise present an unsightly headlamp structure. In order to overcome this problem, it is known to provide a through hole which extends through the housing, including the reflective surface. In such an embodiment, air and moisture within the housing are vented from the interior of the housing, the air and moisture flowing through the through hole and out of the housing. To facilitate such venting, it is known to attach a vent tube to a coupling extending from the exterior of the housing adjacent the through hole. The vent tube serves to direct the air and moisture flowing out of the vent hole, as desired.

One of the problems inherent with such vent hole arrangements is that there is a tendency for the through hole to be quite visible when viewing the reflector through the lens. As a practical matter, the through hole appears as a dark spot upon an otherwise spotless reflective surface. Like the moisture, which in the absence of the vent hole would accumulate in the housing, such a dark spot presents an unsightly headlamp structure.

DISCLOSURE OF THE INVENTION

It is an object of the present invention to provide an improved reflector for use with a lamp.

It is another object of the present invention to obviate the disadvantages of the prior art by providing an improved reflector for use with a lamp.

Another object of the present invention is to provide an improved reflector for use with a lamp, the reflector including a vent hole which does not appear as a dark spot upon the reflective surface.

A further object of the present invention is to provide an improved reflector for use in automobile applications.

Yet a further object of the present invention is to provide an improved reflector for use in an automobile headlamp assembly.

This invention achieves these and other objects by providing a reflector for use with a lamp. The reflector includes a vent hole which extends through a reflector body from an outer surface to an inner surface. The vent hole is provided by first and second apertures. The first aperture is formed by a first enclosure extending into the reflector body from the outer surface towards the inner surface. The second aperture is formed by a second enclosure extending into the reflector body from the inner surface towards the outer surface. The first enclosure is structured and arranged relative to the second enclosure (a) to provide for fluid flow from the outer surface, through and between the first aperture and the second aperture, to the inner surface, and (b) to obscure the first and second apertures when viewing the outer surface.

BRIEF DESCRIPTION OF THE DRAWINGS

This invention may be clearly understood by reference to the attached drawings in which like reference numerals designate like parts and in which.

MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
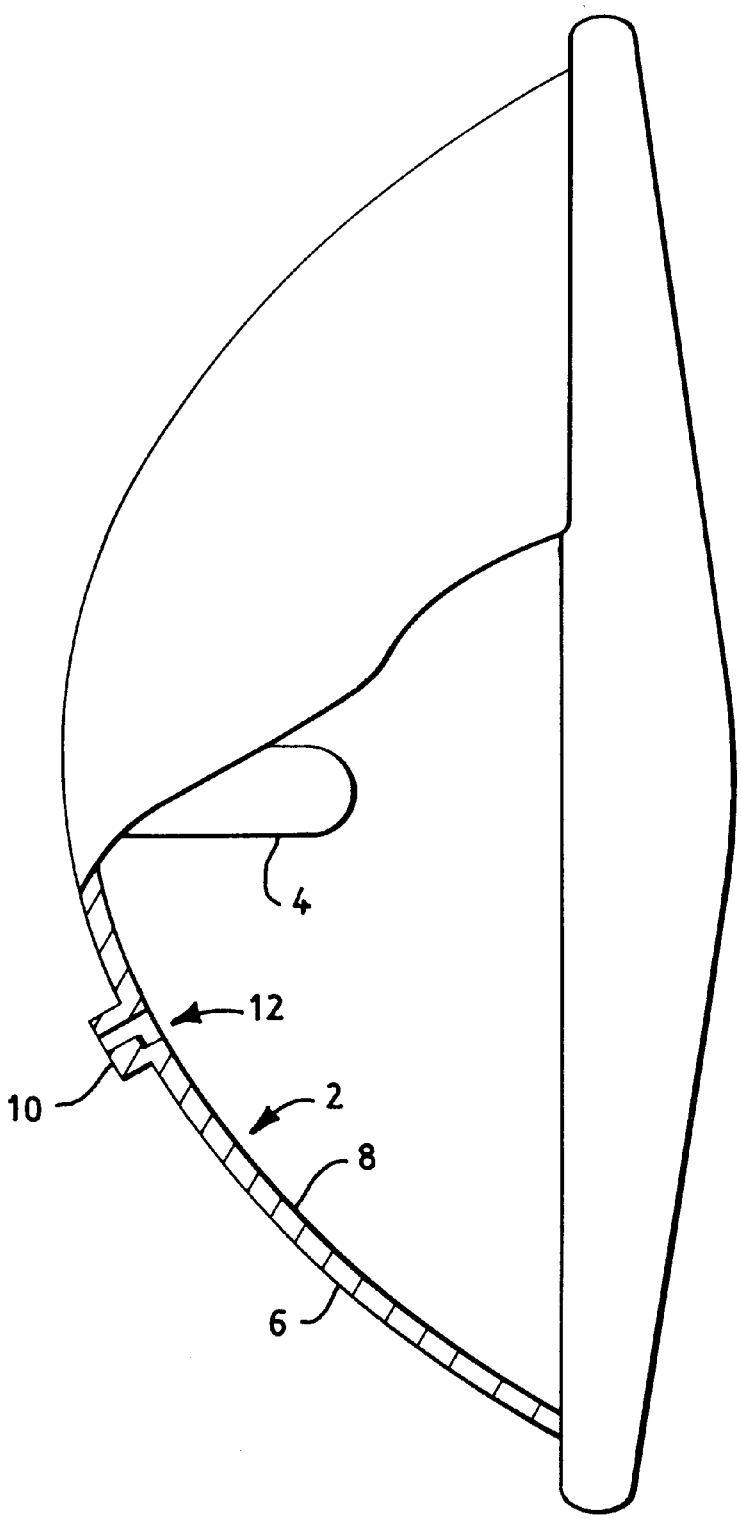
FIG. 1 is a view of one embodiment of the reflector of the present invention in combination with an automobile headlamp assembly.
Figure 3:
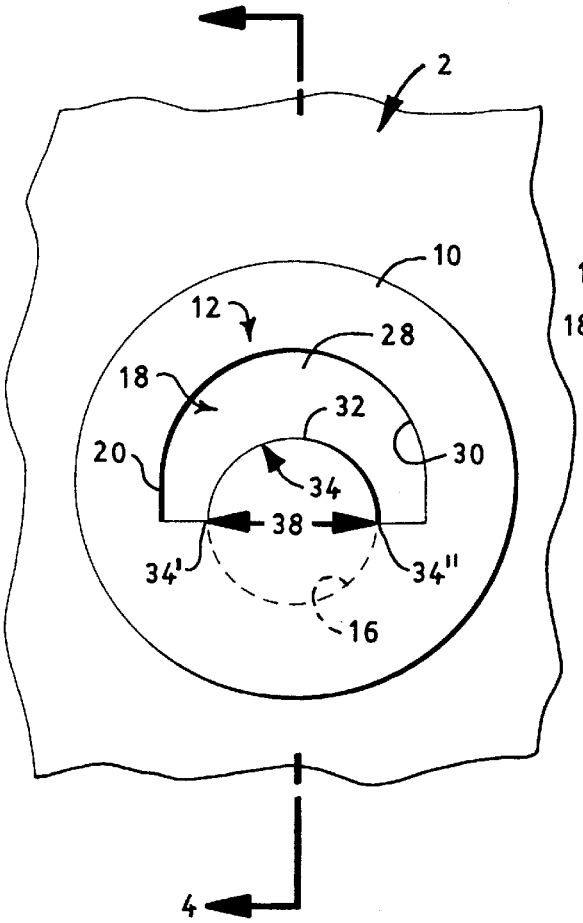
FIG. 3 is a rear view of the portion of FIG. 2.
Figure 4:
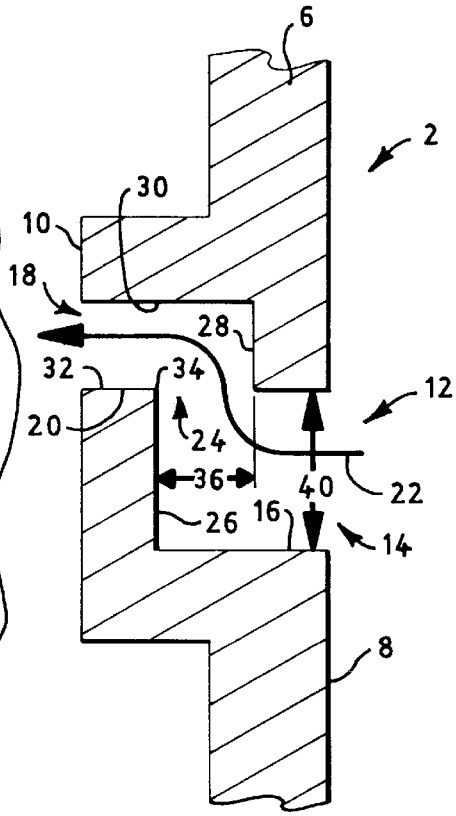
FIG. 4 is a sectional view of FIG. 3 taken along lines 4—4.

The embodiment of this invention which is illustrated in the drawings is particularly suited for achieving the objects of this invention. FIG. 1 illustrates a reflector 2 for use with a lamp 4. Without limitation, reflector 2 and lamp 4 are illustrated in FIG. 1 as components of a lamp assembly for use in an automobile application such as a conventional headlamp. With reference to FIGS. 1 to 4, the reflector 2 includes a reflector body 6 having an outer surface 8 and an inner surface 10. The outer surface 8 comprises a conventional reflective surface which reflects light emitted by lamp 4 in a conventional manner. The reflector 2 includes a vent hole 12 which extends through the reflector body 6 from outer surface 8 to inner surface 10 as best illustrated in FIG. 4 and described hereinafter.

The vent hole 12 comprises a first aperture 14 which is formed by a first enclosure 16 which extends into the reflector body 6 from the outer surface 8 towards the inner surface 10. The vent hole 12 also comprises a second aperture 18 formed by a second enclosure 20 which extends into the reflector body 6 from the inner surface 10 towards the outer surface 8. The first enclosure 16 is structured and arranged relative to the second enclosure 20 to provide for the flow of fluid through the vent hole 12 from outer surface 8 to inner surface 10, and to obscure the vent hole when viewing the outer surface 8 of the reflector 2.

Figure 2:
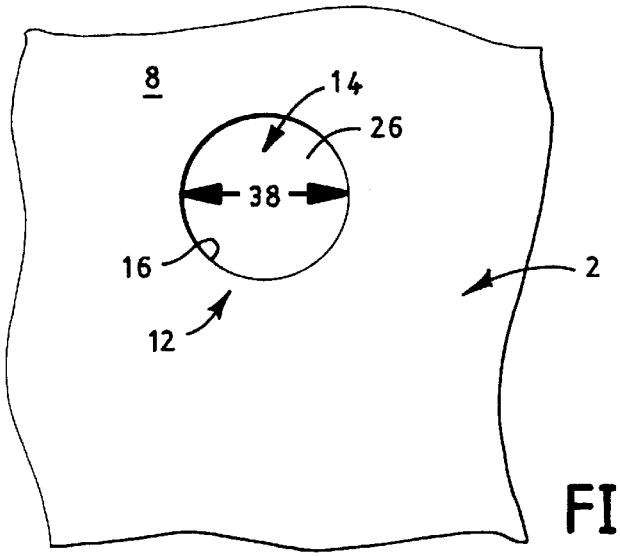
FIG. 2 is a front view of a portion of the reflector of FIG. 1 without the lamp of the headlamp assembly.
Figure 5:
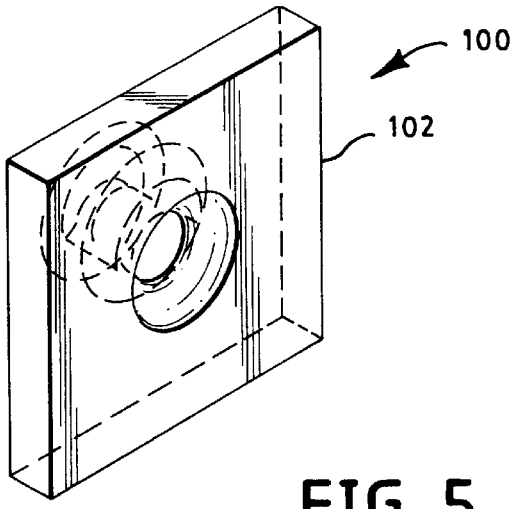
FIG. 5 is a perspective view of a portion of another embodiment of the reflector of the present invention.

To provide for the flow of fluid through the vent hole 12, the first enclosure 16 is structured and arranged relative to the second enclosure 20 to provide for fluid flow from the outer surface 8, through the first aperture 14, between the first aperture 14 and the second aperture 18, and through the second aperture 18 to the inner wall 10, as generally illustrated by fluid flow arrow 22. Fluid flow between the first aperture 14 and the second aperture 18 is provided by an opening 24 located between the first enclosure 16 and the second enclosure 20. To this end, first enclosure 16, including a first enclosure base 26, is overlapped by and intersects the second enclosure 20, including a second enclosure base 28. Such feature is evident with reference to FIGS. 1 to 4, which illustrate the enclosure 16 forming aperture 14 as a cylinder extending into the reflector body 6 from outer surface 8 to the base 26. As illustrated in FIG. 2, the base 26 is circular. As illustrated in FIGS. 3 and 4, the enclosure 20 provides the aperture 18 as a crescent shaped aperture which extends into the reflector body 6 from the inner surface 10 towards the base 28. To form the crescent shaped aperture 18, the enclosure 20 comprises a concave surface 30 and a convex surface 32 extending from the inner surface 10 towards the outer surface 8. An upper segment of the circular peripheral edge of the circular enclosure base 26, equal to about 180B of the entire circular periphery of the enclosure base 26, forms a line of coincidence at 34 with a periphery segment of the convex surface 32. The line of coincidence 34 extends from 34' to 34" as illustrated in FIG. 3. With reference to FIG. 4, the first enclosure base 26 is spaced from the second enclosure base 28 a distance 36. The overlapping of the enclosure 16 by the enclosure 20 effected by the coincident structural feature at line of coincidence 34 and the spacing at 36 provides for the intersection of the enclosures 16 and 20 thereby forming the opening 24 through which fluid may flow in direction 22 from aperture 14 to aperture 18.

To provide for obscuring the vent hole 12 when viewing the outer surface 8 of the reflector 2, the first enclosure 16 is structured and arranged relative to the second enclosure 20 so that the first enclosure base 26 is distanced from and overlays the aperture 14, when viewing aperture 14 from base 26. By providing a base, such as base 26, having a diameter 38 which is equal to the diameter 40 of the aperture 14, and at a different plane than that of the outer surface 8, the base 26 acts as a wall which effectively blocks the view of vent hole 12 when viewed from outer surface 8. In other words, although the vent hole 12 is present, by orienting the base 26 so that it is spaced from yet overlaps or covers the aperture 14, the vent hole becomes visually indistinct. Obscuring the vent hole can be facilitated further by aluminizing the outer surface 8 and the enclosure 16, including the enclosure base 26.

Figure 10:
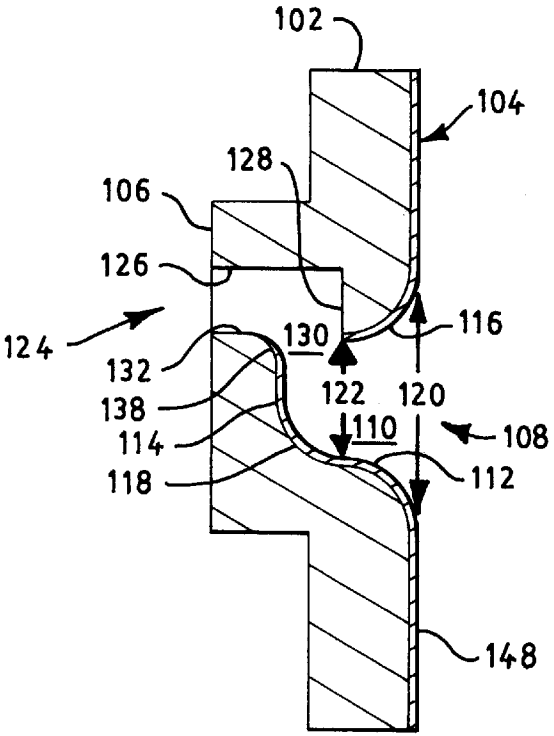
FIG. 10 is a sectional view of FIG. 9 taken along lines 10—10.

FIGS. 5 to 10 illustrate an alternative embodiment of the reflector of the present invention. FIGS. 5 to 10 illustrate a portion of a reflector 100 such as the portion of reflector 2 illustrated in FIGS. 2 to 4. Reflector 100 includes a reflector body 102 having an outer surface 104 and an inner surface 106. The outer surface 104 comprises a conventional reflective surface which reflects light emitted by a lamp (not shown) in a conventional manner. The reflector 100 includes a vent hole 108 which extends through the reflector body 102 from outer surface 104 to inner surface 106 as best illustrated in FIG. 10 and described hereinafter.

The vent hole 108 comprises a first aperture 110 which is formed by a first enclosure 112 which extends into the reflector body 102 from the outer surface 104 to a first enclosure base 114 within the reflector body. The first enclosure comprises a first portion 116 and a second portion 118. The first portion 116 is shaped like a cone extending from a larger opening 120 at the outer surface 104 to a smaller opening 122 within the reflector body 102. The second portion 118 extends from the smaller opening 122 and merges with the first enclosure base 114. In the embodiment illustrated in FIGS. 5 to 10, the cone which provides the first portion 116 is formed by a first wall which is convex towards the larger opening 120, as best illustrated in FIG. 10. In contrast, the second portion 118 is formed by a second wall which is concave towards the larger opening 120. The concave and convex walls merge at their junction as illustrated in FIG. 10 to eliminate any sharp edges therebetween.

Figure 6:
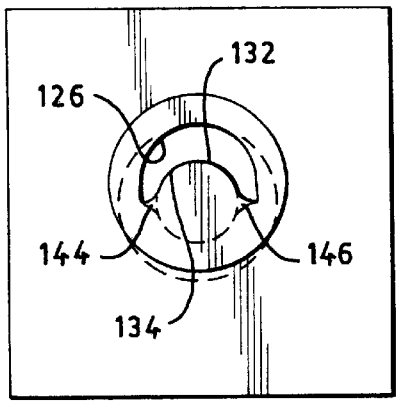
FIG. 6 is a rear view of FIG. 5.
Figure 7:
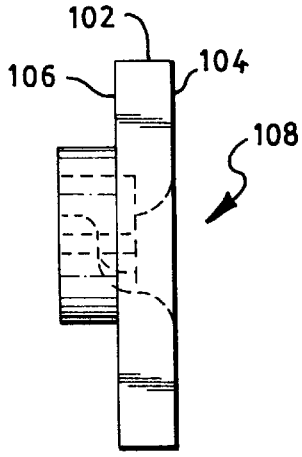
FIG. 7 is a side view of FIG. 5.
Figure 8:
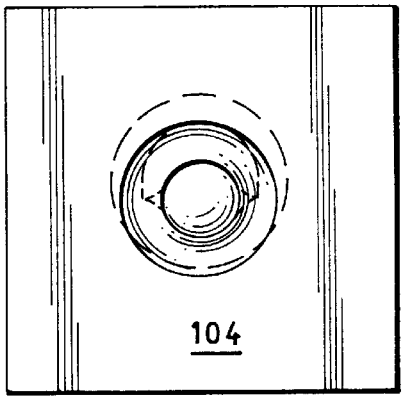
FIG. 8 is a front view of FIG. 5.
Figure 9:
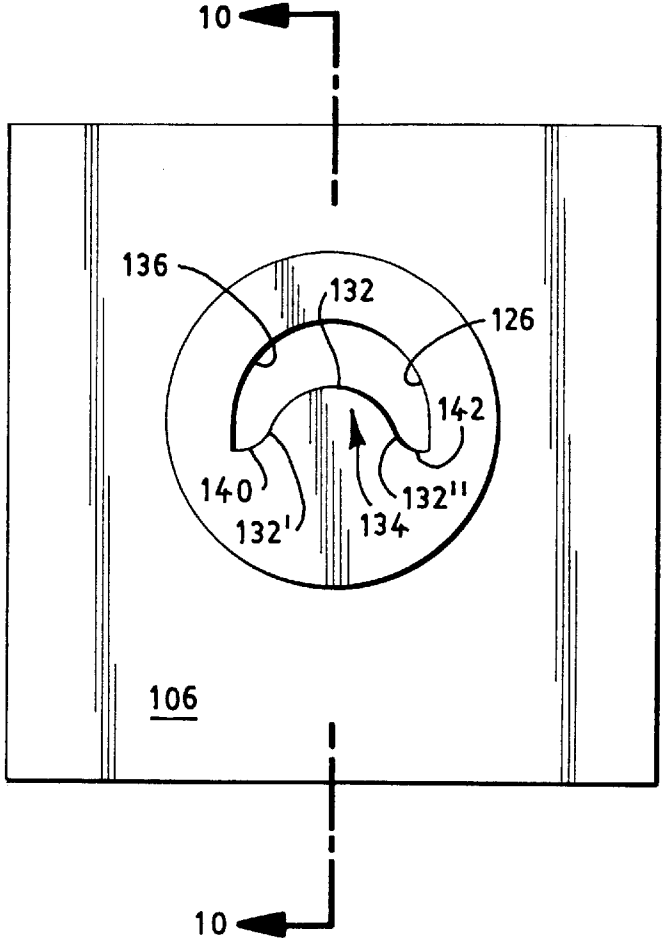
FIG. 9 is an enlarged rear view of FIG. 5.

The vent hole 108 comprises a second aperture 124 which is formed by a second enclosure 126 which extends into the reflector body 102 from the inner surface 106 to a second enclosure base 128 within the reflector body. Like the embodiment of FIGS. 1 to 4, the second enclosure 126 is crescent shaped as best illustrated in FIG. 9. Fluid flow between apertures 110 and 124 is possible through an opening 130 located between the enclosures 112 and 126. To this end, the second portion 118 of the first enclosure 112, and the first enclosure base 114, are overlapped by and intersect the second enclosure 126, including the second enclosure base 128. Such feature is evident with reference to FIG. 10. As illustrated in FIGS. 6 and 10, an upper segment of the circular peripheral edge of the enclosure base 114 forms a line of coincidence at 132 with a periphery segment of a convex surface 134 of the enclosure 126, convex surface 134 and concave surface 136 forming the crescent shaped aperture 124. The line of coincidence 132 extends from 132' to 132" as illustrated in FIG. 9. With reference to FIG. 10, the enclosure base 114 is spaced from the second enclosure base 128. The overlapping of the enclosure 112 by the enclosure 126 effected by the coincident structural feature at line of coincidence 132 and the spacing between bases 114 and 128 provide for the intersection of the enclosures 112 and 126 thereby forming the opening 130 through which fluid may flow.

To provide for obscuring the vent hole 108 when viewing the outer surface 104 of the reflector 100, the first enclosure 112 is structured and arranged relative to the second enclosure 126 so that the second portion 118 and second enclosure base 114, are distanced from and overlay the small opening 122, when viewing aperture 110 from base 114. Obscuring of the vent hole 108 is further facilitated by providing the convex wall at the first portion 116 and the concave wall at the second portion 118, and merging such walls as illustrated in FIG. 10 to eliminate any sharp edges at the junction between the walls, as discussed above. To further facilitate obscuring the vent hole 108, the enclosure base 114 may include a length 138 of the segment of the circular periphery of the enclosure base 114 adjacent the line of coincidence 132 which is convex towards the opening 120. Length 138 extends from 132' to 132". In addition, in the embodiment illustrated in FIGS. 5 to 10, concave surface 136 is coupled to the convex surface 134 at a first length 140 and a second length 142, respectively, the lengths 140 and 142 each being rounded in a direction away from the concave surface 136, as best illustrated in FIG. 9. In addition, the first enclosure base 114 includes a first rounded segment 144 and a second rounded segment 146 which are rounded towards and extended to the first length 140 and second length 142, respectively, as best illustrated in FIG. 6. Such interrelationship between lengths 140 and 142 and respective rounded segments 144 and 146 further facilitate obscuring of the vent hole 108. The vent hole may be further obscured by aluminizing the outer surface 104, the portions 116 and 118 of the first enclosure 112, and the first enclosure base 114, as illustrated at 148.

The reflector of the present invention includes a vent hole which does not appear as a dark spot upon the reflective outer surface of the reflector, the vent hole being obscured when looking at such outer surface. Although the vent hole exists, it is obscured sufficiently so as not to provide a cosmetically disturbing feature. Such a reflector is therefore particularly useful in automobile applications. One such application is with an automobile headlamp assembly, the reflector being cosmetically pleasing yet providing an obscured vent hole which vents moisture and air from within the headlamp housing. To facilitate such venting, a protuberance may be provided which forms part of the inner surface, the protuberance being structured and arranged for attachment of a vent tube thereto. The vent tube directs the air and moisture flowing out of the vent tube as desired. For example, in the embodiment of the present invention illustrated in FIGS. 5 to 10, a protuberance in the shape of a cylindrical body 150 is provided, the cylindrical body comprising the inner surface 106 as illustrated in FIG. 10. A rubber tube 152 can be attached to the cylindrical body 150 to direct the air and moisture flowing out of the vent hole 108. A similar protuberance is provided in the embodiment illustrated in FIGS. 1 to 4.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A reflector for use with a lamp, comprising:

a reflector body having an outer surface and an inner surface;

a first aperture formed by a first enclosure extending into said reflector body from said outer surface towards said inner surface; and a second aperture formed by a second enclosure extending into said reflector body from said inner surface towards said outer surface, said first enclosure being structured and arranged relative to said second enclosure (a) to provide for fluid flow from said outer surface, through and between said first aperture and said second aperture, to said inner surface, and (b) to obscure said first aperture and said second aperture when viewing said outer surface and said first enclosure extends from said outer surface to a first enclosure base within said reflector body, said first enclosure having (a) a first portion shaped like a cone extending from a larger opening at said outer surface to a smaller opening within said reflector body, and (b) a second portion extending from said smaller opening to said first enclosure base; and further wherein said second enclosure extends from said inner surface to a second enclosure base within said reflector, said second enclosure and said second enclosure base overlapping said second portion and said first enclosure base within said reflector body to provide an opening, and allow said fluid flow, between said first aperture and said second aperture, said first enclosure base spaced from and overlaying said smaller opening and wherein said second enclosure is crescent shaped and comprises a concave surface, and a convex surface, extending from said inner surface towards said outer surface.

2. The reflector of claim 1 wherein said concave surface is coupled to said convex surface at a first length and a second length, respectively, said first length and said second length each being rounded in a direction away from said concave surface, and further wherein said first enclosure base includes a first rounded segment and a second rounded segment, said first rounded segment and said second rounded segment being rounded towards and extended to said first length and said second length, respectively.

3. The reflector of claim 1 wherein a peripheral edge of said first enclosure base forms a line of coincidence with a periphery segment of said convex surface.

4. The reflector of claim 3 wherein a first enclosure base length adjacent said peripheral edge of said first enclosure base is convex towards said smaller opening.

5. A reflector for use with a lamp, comprising:

a reflector body having an outer surface and an inner surface;

a first aperture formed by a first enclosure extending into said reflector body from said outer surface;

a second aperture formed by a second enclosure extending into said reflector body from said inner surface;

means for forming a fluid flow opening between said first aperture and said second aperture; and means for obscuring said first aperture and said second aperture when viewing said outer surface, and wherein said second enclosure overlaps said first enclosure enclosing an opening between said first enclosure and said second enclosure and forming said fluid flow opening; and said first enclosure extends from said outer surface to a first enclosure base within said reflector body, and further wherein said first enclosure base is spaced from and overlays said first aperture forming said obscuring means; and wherein said outer wall and said first enclosure, including said first enclosure base comprise a reflective surface.

* * * * *